United States Patent [19]

Godwin et al.

[11] 4,315,613

[45] Feb. 16, 1982

[54] MECHANICAL HEIGHT ADJUSTMENT MECHANISM FOR CHAIRS

[75] Inventors: Robert H. Godwin; Herbert E. Collignon, both of Evansville, Ind.

[73] Assignee: Bliss & Laughlin, Oak Brook, Ill.

[21] Appl. No.: 90,339

[22] Filed: Nov. 1, 1979

[51] Int. Cl.[3] ..... A47C 3/24

[52] U.S. Cl. ..... 248/406; 108/147; 297/349

[58] Field of Search ..... 248/406, 405; 108/142, 108/144, 146, 147; 297/349, 345

[56] References Cited

U.S. PATENT DOCUMENTS

| | | | |
|---|---|---|---|
| 3,391,893 | 7/1968 | Doerner | 248/405 X |
| 3,504,643 | 4/1970 | Burst et al. | 108/144 |
| 3,741,514 | 6/1973 | Shurr | 297/345 X |
| 3,799,486 | 3/1974 | Mohr et al. | 248/406 |
| 3,870,271 | 3/1975 | Bowman | 248/406 |
| 3,991,965 | 11/1976 | Westover | 248/406 |
| 4,026,509 | 5/1977 | Wolters | 108/147 X |

FOREIGN PATENT DOCUMENTS

| | | | |
|---|---|---|---|
| 2343328 | 3/1974 | Fed. Rep. of Germany | 248/405 |
| 1160635 | 8/1969 | United Kingdom . | |

*Primary Examiner*—James T. McCall

*Attorney, Agent, or Firm*—Woodard, Weikart, Emhardt & Naughton

[57] ABSTRACT

A spindle assembly for a chair or the like includes an outer tube tapered to fit in a chair base, an inner tube having an upper end tapered to fit the chair control, and a bushing near the upper end of the outer tube to guidingly receive the inner tube therein. A screw is provided in the assembly and threadedly engaged with the inner tube, with means to prevent the screw from rotating in the absence of any axial external load on the assembly, whereby rotation of the inner tube with respect to the outer tube will cause a change of overall length of the assembly, to provide a height adjustment for a chair assembly secured thereto. Spring means employed in the assembly resiliently support the seat under a seating load and also accommodate disengagement of a rotational lock to permit swiveling of the seat with respect to the base without any change of overall height.

8 Claims, 4 Drawing Figures

MECHANICAL HEIGHT ADJUSTMENT MECHANISM FOR CHAIRS

BACKGROUND OF THE INVENTION

1. Field of the Invention

This invention relates generally to vertically adjustable swivel chairs, and more particularly to a support spindle assembly for such chairs.

2. Description of the Prior Art

Swivel chairs are well known and widely used. Early swivel chairs included a screw secured to either the seat or base and useful to adjust the height by turning the screw or nut. However, the chairs could not be swiveled without changing the chair height. The latter problem was subsequently dealt with by a separate collar or, handwheel or knob (as in U.S. Pat. No. 2,219,814, for example).

Another type of swivel chair known to us, had the capability of height adjustment without the use of a screw. Such chairs used various types of sleeves and clutching means to permit height adjustment, while the chair could be swiveled without it affecting the height at all. Examples are shown in U.S. Pat. Nos. 2,338,783 and 2,469,896.

A further type of vertically adjustable swivel chairs employs fluids therein for height adjustment. An example is shown in U.S. Pat. No. 2,505,100. Some of these have an advantage over the types mentioned above, in the respect that they may be useful to provide some cushioning under seating loads.

The above mentioned types of adjustable spindles have some disadvantages. The first mentioned type, although simple in construction, provides no cushioning and produces a change of height during swiveling while the seat is occupied. If the change is so little as not to be noticable, then it takes too many turns to obtain a change of height, when it is desired. If the screw is such that the height change will be noticed, then the swiveling is either going to be less free than desired, or the height change will be objectionable.

In the type using the clutching device, there is considerable complexity, as well as the necessity for understanding the mechanism in order to obtain the desired height adjustment. For example, at least one such device requires that the chair be pulled to maximum height, before it can be lowered. Then it must be lowered all the way before it can be locked at any desired height upon raising it again.

The fluid operated height adjustment involves some complexity and expense, plus the necessity for adequate and secure valving and sealing of the fluids employed.

The present invention is addressed to solving a continuing need for a swivel chair column assembly in which height adjustment can be readily secured, swiveling can be readily achieved without a change of height when the seat is occupied, and cushioning of seating loads is also provided, in a comparatively simple and inexpensive assembly.

SUMMARY OF THE INVENTION

Described briefly, in a typical embodiment of the present invention, a vertically adjustable spindle assembly for a chair or the like includes first column means having an end portion adapted to attachment to conventional base means, and second column means having an upper end adapted to attachment to conventional seating means. Guide means are provided for guiding vertical relative movement of the column means for chair height adjustment. Vertical support means are associated with the two column means and include cooperable screw means thereon for providing relative vertical movement between the first and second column means upon relative rotation therebetween when no one is seated on seating means atop the second column means. Resilient means are provided, cooperating with the column and support means to provide shock load cushioning upon application of seating loads, and also accommodate disablement of the height adjusting feature when there is a load applied to the seating means.

DESCRIPTION OF THE PREFERRED EMBODIMENT

Figure 1:
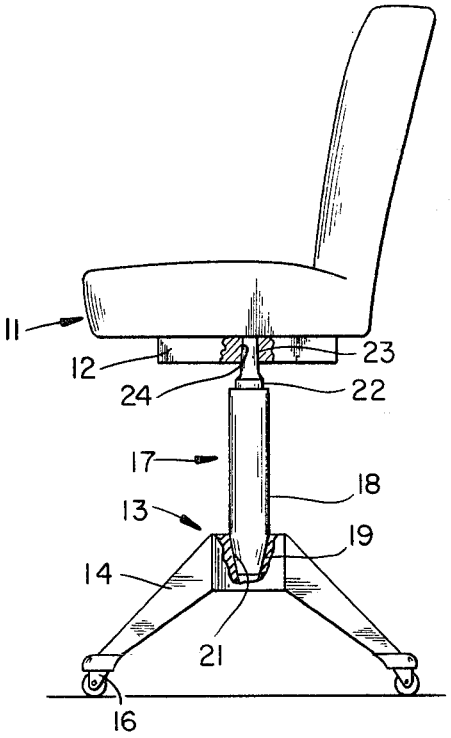
FIG. 1 is an elevational view on a small scale, of a chair assembly employing a vertically adjustable spindle assembly according to a typical embodiment of the present invention.

Referring now to the drawings in detail, the chair assembly of FIG. 1 includes a seat 11 secured to a chair control 12, and a base 13 including four legs 14 supported on casters 16. The column assembly 17 includes an outer tube 18 having a No. 5 Morse Taper (shown exaggerated) at its lower end 19 received in a matching socket 21 in the base 13. The column assembly includes an upper tube 22 extending down inside the lower tube 18 and having a No. 3 Morse Taper (shown exaggerated) at its upper end 23 received in a matching socket 24 in the chair control 12.

Figure 2:
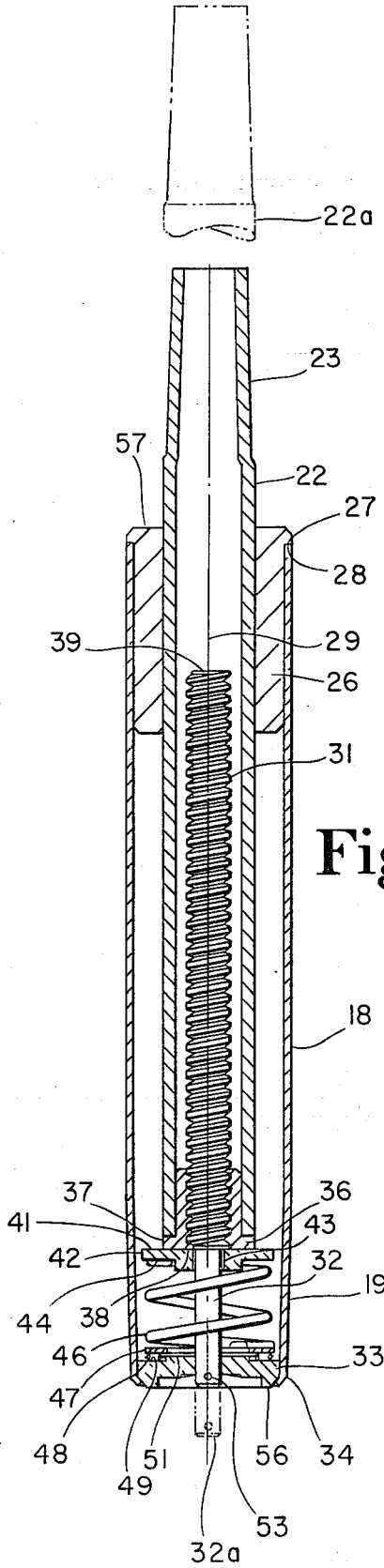
FIG. 2 is a longitudinal sectional view of the spindle assembly employed according to a typical embodiment of the present invention.

Referring now to FIG. 2, an oil-impregnated metal bushing 26 is secured in the upper end of tube 18 by a press fit, and has a radial flange 27 at the upper end thereof, with the downwardly facing shoulder 28 thereon abuttingly engaging the upper end of tube 18. This bushing slidingly and fittingly receives the inner tube 22 to provide guidance and maintain the coaxial relationship of the two tubes on the axis 29.

A screw 31, coaxial with the tubes, is disposed inside the inner tube and has an integral stem 32 extending down from the lower end of the screw thread and through a powdered metal retaining and guide bushing 33 staked in the lower end of tube 18. The retaining bushing is secured in the housing tube 18 by forming the end of the tube radially inward as shown at 34 at the bottom of the tube. Thus, the housing tube 18 and spindle tube 22 are both seamless steel tubes swaged to provide the respective tapers thereon, and the outside cylindrical surface of the spindle tube may be ground, if needed, to properly fit the spindle bushing 26. The retainer bushing 33 serves as a guide for the stem 32 of the height adjusting screw.

A spindle adjusting nut 36 is press fitted into the bottom of the spindle tube 22 and has a radially extending flange 37 thereon abuttingly engaging the bottom of the spindle tube. This nut is threadedly received on the spindle screw threads. These threads extend from the shoulder 38 at the upper end of the stem 32 all the way to the upper end 39 of the screw. This shoulder is received on the upper face 41 of a spring centering thrust washer 42 which is piloted by its central aperture 43 slidably received on the stem 32. The lower face 44 of thrust washer 42 abuttingly engages the upper end of a coil spring 46 whose lower end engages the upper face of thrust washer 47, whose lower face is supported on an anti-friction bearing assembly 48 received on the upper face 49 of the retainer bushing 33. This bearing assembly is centered on a boss 51 in the upper face of the retainer bushing 33 and is normally a needle bearing assembly although other types of anti-friction bearings might also be employed. The expression "anti-friction" as used herein refers to a type of bearing having some sort of rolling relationship between the two members applying thrust to it in a direction parallel to the axis 29 of the column assembly. The illustrated needle bearing assembly is an example.

Figure 3:
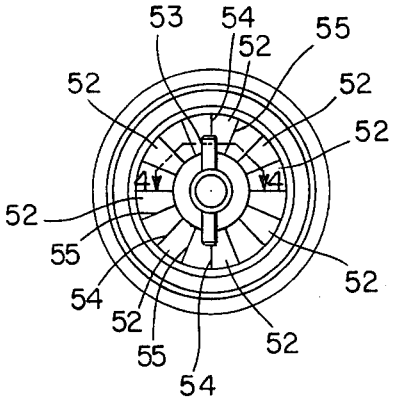
FIG. 3 is a bottom end view of the spindle assembly.
Figure 4:
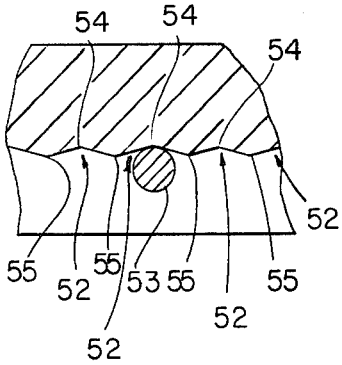
FIG. 4 is a fragmentary section taken at line 4—4 in FIG. 3 and viewed in the direction of the arrows.

As best shown in FIG. 3, the lower face of the retainer bushing 33 has a plurality of radially extending downwardly facing grooves 52 therein between the base lines 54 and ridges 55. The stem 32 of the spindle screw has a pin 53 therethrough perpendicular to the axes 29. This pin is receivable in any one of the grooves in the bushing 33. When so-received, it will prevent relative rotation between the screw and the bushing retainer 33 by engagement with a groove wall sloping from the line 54 to ridge 55 as better shown in FIG. 4. Accordingly, relative rotation between the screw and tube 18 is prevented. In this event, whenever the inner tube 22 is rotated in a counterclockwise direction when viewed from above, the nut 36 will move upward on the tube 31 and the tube 22 accordingly will move upward. The thrust washer 42 will not move upward since it is stopped on the shoulder 38 on the screw. Although the illustrated pin 53 is solid, it may be preferable to use a longitudinally split tubular pin referred to as a "Roll-pin".

As an example, for an assembly in the minimum height adjustment condition as shown in the solid outline of FIG. 2, where the overall length from the lower end 56 of the retainer bushing 33 to the upper end 57 of the upper tube 22 is 266.16 mm, the available adjustment to the maximum safe height position located by the dotted outline 22A is 120 mm. At any position throughout this total available height, the spring 46 maintains the pin 53 securely within one of the detent grooves 52. This relationship is true for the empty chair condition where the preload of the springs against the two thrust washers is adequate to support the weight of the chair and the chair control on the upper tube without departure at all of the pin from the detent grooves. It is expected that a 50 pound preload on the spring will suffice for this purpose.

When a compressive load is externally applied axially to the assembly in a direction tending to move the opposite ends of the two column tubes toward each other, such load over a minimum of approximately 50 pounds will then be transferred from the outer tube through the nut 36 and screw and shoulder 38 at the bottom of the screw to the upper thrust washer 42 which will then transfer that load to the spring. When the total load on the spring approaches 100 pounds, the spring will commence to compress, whereupon the stem 32 will begin to exit from the relatively flush relationship to the plane of the bottom 58 of the bushing 33. A load of 100 pounds will be sufficient for the pin to clear the ridges 55 of the detent serrations, and permit the stem to turn freely. At maximum spring compression, the stem may project to the dotted line position designated 32A in FIG. 2, which may be 8.89 mm below the bottom in an apparatus dimensioned as above stated.

As an example, a spring used may be a crome vanadium steel, medium pressure die spring having a spring rate such that it takes 450 pounds total load to provide the full 8.89 mm travel. This is an example where the outside diameter of the spring is about 31.8 mm. In the same example, the overall diameter of the outer tube may be 39.75 mm and that for the spindle tube may be about 22.3 mm. An example of a suitable thrust bearing for the illustrated examples is that manufactured by Torrington Company, Part No. NTA-1220.

From the foregoing description, it should be apparent that the apparatus of the present invention provides an easy reliable method for changing the height of a chair and providing a cushioning effect when a person is seated. The height can be adjusted by simply rotating the chair counter-clockwise for an increase in height, and clockwise for a decrease in height. When a person is seated in the chair, the bottom spring is slightly deflected and the pin located at the lower end of the screw stem becomes disengaged from the detent grooves, allowing the chair to be rotated without affecting the height.

The apparatus has simple construction but with aesthetic appeal, and no exposed screw threads. The porous metal bearing at the top is adequate to react moment for offset loading, and the needle bearing at the bottom reacts the thrust loads applied to the seat. The spring reacts shock loads. No screwdrivers, wrenches or handles are needed to provided a desired height adjustment.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A vertically adjustable spindle assembly for a chair or the like, said assembly comprising:

first column means having an end portion adapted to attachment to base means;

second column means on said first column means and having an end portion adapted to attachment to seating means;

first guide means on said first column means and guidingly engaging said second column means for guiding relative linear movement of said second column means on said first column means;

first support means on said first column means and engaging said second column means for controlling longitudinal positioning of said second column means relative to said first column means;

said first support means and second column means having linear longitudinal axes and being rotatable with respect to each other about said axes, said first support means and second column means having cooperable screw means thereon for causing relative linear movement between said first support means and said second column means upon relative rotation therebetween, to thereby change longitudinal position of said second column means relative to said first column means, said cooperable screw means including a screw on said first support means and a nut secured in said second column means, said nut being threaded onto said screw;

first rotational stop means in a cooperating relationship with said first column means and said first support means to prevent relative rotation between said first support means and said first column means in the absence of an external compressive load on said first and second column means in a direction tending to move said end portions toward each other, whereby rotation of said second column means relative to said first column means will change longitudinal position of said second column means on said first column means;

said first support means further including a compression spring inside said first column means in a force transmitting relationship to said first and second column means and applying a force on said first column means and through said screw to said second column means and thereby urging said first and second column means in a direction tending to move said end portions away from each other and establishing and maintaining the said cooperating relationship preventing said relative rotation.

2. The assembly of claim 1 wherein:

the force normally applied by said spring is at least 50 pounds, and the relationship of said spring and stop maintaining means is such that compression of said spring by a compressive force applied to said first and second column means in a direction tending to move said end portions toward each other and in excess of 100 pounds terminates said cooperating relationship.

3. The assembly of claim 1 and further comprising:

first linear stop means secured to said first column means;

said first support means including first and second thrust washers, said first thrust washer abuttingly engaging one end of said spring, and applying the spring force to a radially extending annular shoulder on said screw, and said second thrust washer engaging the other end of said spring and applying the spring force to said first linear stop means.

4. The assembly of claim 3 and further comprising:

first anti-friction bearing means engaging one of said thrust washers and co-operating therewith to apply the spring force therethrough.

5. The assembly of claim 4 and further comprising:

a base secured to said first column means; and a seat secured to said second column means.

6. The assembly of claim 4 wherein:

said rotational stop means include a detent pin located in a portion of said support means and extending transverse to the axis thereof, and at least one detent groove in said linear stop means, said groove extending transverse to said axes and normally receiving said pin therein during said absence of external compressive load.

7. The assembly of claim 6 wherein:

said first column means include an upright first tube having said first end portion at the lower end thereon;

said second column means include an upright second tube coaxial with said first tube and extending up from inside said first tube out through the upper end of said first tube and having said end portion thereof at the upper end;

said first guide means include a bushing affixed in the upper end of said first tube and fittingly and slidingly receiving said second tube therethrough;

said screw has a longitudinally extending screw thread thereon, and said second column means having said nut secured therein at the lower end of said second upright tube;

said linear stop means is a retainer having a central aperture guidingly receiving a stem on said support means extending downwardly from said screw thread thereon, said stem being the portion of said support means having said detent pin therein;

said anti-friction bearing means is mounted on top of said retainer and supporting the one of said thrust washers located under said spring; and the other of said thrust washers has a spring piloting surface thereon receiving the upper end of said spring, with said radially extending annular shoulder being at the lower end of said screw thread immediately above said stem.

8. The assembly of claim 7 wherein:

said spring is a medium pressure die spring normally maintaining said pin in said detent groove while applying a spring load in excess of 50 pounds and having a spring rate to require an additional 300 pounds at least to compress the spring to a point where the distance between said thrust washers is half the distance that it is when said pin is in said detent.

* * * * *